US007827834B2

(12) United States Patent
Lim et al.

(10) Patent No.: US 7,827,834 B2
(45) **Date of Patent: *Nov. 9, 2010**

(54) BEARING HOUSING ASSEMBLY OF DRUM-TYPE WASHING MACHINE AND DRUM-TYPE WASHING MACHINE WITH THE SAME

(75) Inventors: Hee Tae Lim, Bucheon-si (KR); Jae Won Chang, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 919 days.

This patent is subject to a terminal disclaimer.

(21) Appl. No.: 11/529,759

(22) Filed: Sep. 29, 2006

(65) Prior Publication Data

US 2007/0074543 A1 Apr. 5, 2007

(30) Foreign Application Priority Data

Sep. 30, 2005 (KR) ..... 10-2005-0092609

(51) Int. Cl.
*D06F 21/00* (2006.01)

(52) U.S. Cl. ..... 68/140; 68/3 R; 68/139

(58) Field of Classification Search ..... 68/104, 68/140, 3 R, 139
See application file for complete search history.

(56) References Cited

U.S. PATENT DOCUMENTS

| | | | | |
|---|---|---|---|---|
| 912,038 | A | 2/1909 | Seifert | |
| 1,077,043 | A | 10/1913 | Darrow | |
| 1,470,245 | A | 10/1923 | Slider | |
| 1,611,895 | A | 12/1926 | Dienner | |
| 1,787,427 | A | 1/1931 | Eckhard | 68/140 |
| 2,089,066 | A | 8/1937 | Morrill | 248/26 |
| 2,152,458 | A | 3/1939 | Bergman | 172/36 |
| 2,153,418 | A | 4/1939 | Haberstump | 286/5 |
| 2,165,884 | A | 7/1939 | Chamberlin et al. | 8/159 |
| 2,191,607 | A | 2/1940 | Chamberlin et al. | 237/20 |
| 2,296,257 | A | 9/1942 | Breckenridge | 68/24 |
| 2,296,261 | A | 9/1942 | Breckenridge et al. | 68/24 |
| 2,296,267 | A | 9/1942 | Baird | 68/23 |
| 2,323,765 | A | 7/1943 | Haberstump | 68/13 |
| 2,356,816 | A | 8/1944 | Breckenridge et al. | 68/12 |
| 2,356,818 | A | 8/1944 | Bruckman | 68/24 |
| 2,389,774 | A | 11/1945 | Haberstump | 220/10 |

(Continued)

FOREIGN PATENT DOCUMENTS

CN 1332816 A 1/2002

(Continued)

OTHER PUBLICATIONS

Chinese Office Action issued in Chinese Patent Application No. 200610142200.6 dated Mar. 8, 2010.

(Continued)

*Primary Examiner*—Michael Kornakov
*Assistant Examiner*—Katelyn B Whatley
(74) *Attorney, Agent, or Firm*—KED & Associates, LLP

(57) ABSTRACT

A bearing housing assembly and drum-type washing machine having the same are provided. Bearings are received in the bearing housing assembly. The bearing housing assembly may be formed by insert injection molding, and a damper for damping vibration of a drum may be connected to a tub by a damper bracket.

10 Claims, 7 Drawing Sheets

U.S. PATENT DOCUMENTS

| | | | | |
|---|---|---|---|---|
| 2,408,509 | A | 10/1946 | Clark | 68/23 |
| 2,434,476 | A | 1/1948 | Wales | 68/19 |
| 2,498,181 | A | 2/1950 | Reiter | 259/81 |
| 2,509,516 | A | 5/1950 | Murphy | 29/215 |
| 2,510,836 | A | 6/1950 | Russell et al. | 68/24 |
| 2,521,578 | A | 9/1950 | Haberstump | 68/19 |
| 2,526,002 | A | 10/1950 | Brotman | 68/140 |
| 2,526,048 | A | 10/1950 | Russell | 68/24 |
| 2,527,239 | A | 10/1950 | Woodson | 68/23 |
| 2,541,166 | A | 2/1951 | Leef | 68/140 |
| 2,542,509 | A | 2/1951 | Goriup | 68/153 |
| 2,556,490 | A | 6/1951 | Chamberlin | 8/159 |
| 2,565,604 | A | 8/1951 | Geiger | 68/140 |
| 2,579,472 | A | 12/1951 | Chamberlin et al. | 68/24 |
| 2,579,836 | A | 12/1951 | Lee et al. | 260/26 |
| 2,589,284 | A | 3/1952 | O'Neil | 34/77 |
| 2,593,752 | A | 4/1952 | Haberstump | 68/61 |
| 2,615,320 | A | 10/1952 | Balaieff | 68/24 |
| 2,644,326 | A | 7/1953 | Worst | 68/23 |
| 2,656,700 | A | 10/1953 | Smith | 68/23 |
| 2,711,297 | A | 6/1955 | Thiele | 248/18 |
| 2,717,135 | A | 9/1955 | Douglas | 248/20 |
| 2,758,685 | A | 8/1956 | Sisson | 192/3.5 |
| 2,774,621 | A | 12/1956 | Kilbourne, Jr. | 228/23 |
| 2,785,557 | A | 3/1957 | Stilwell, Jr. | 68/12 |
| 2,836,046 | A | 5/1958 | Smith | 68/24 |
| 2,843,314 | A | 7/1958 | Hansen | 230/232 |
| 2,873,599 | A | 2/1959 | Buechler | 68/24 |
| 2,882,706 | A | 4/1959 | Brucken | 68/23 |
| 2,895,319 | A | 7/1959 | Rochefort | 68/3 |
| 2,908,871 | A | 10/1959 | McKay | 331/108 |
| 2,930,217 | A | 3/1960 | Rehmke | 68/24 |
| 2,972,877 | A | 2/1961 | Platt | 68/18 |
| 2,984,094 | A | 5/1961 | Belaieff | 68/24 |
| 2,986,914 | A | 6/1961 | Brucken | 68/12 |
| 2,990,706 | A | 7/1961 | Bochan | 68/12 |
| 2,995,023 | A | 8/1961 | Douglas | 68/131 |
| 3,066,522 | A | 12/1962 | Steinmüller | 68/24 |
| 3,089,326 | A | 5/1963 | Belaieff | 68/24 |
| 3,098,581 | A | 7/1963 | Marsilio | 220/46 |
| 3,153,951 | A | 10/1964 | Whelan | 74/665 |
| 3,178,916 | A * | 4/1965 | Belaieff et al. | 68/23.2 |
| 3,197,983 | A | 8/1965 | Ilmer | 68/24 |
| 3,206,267 | A | 9/1965 | Gruner et al. | 312/228 |
| 3,257,830 | A | 6/1966 | Shelton | 68/133 |
| 3,273,361 | A | 9/1966 | Smith | 68/12 |
| 3,333,444 | A | 8/1967 | Bochan | 68/208 |
| 3,356,222 | A | 12/1967 | Belaieff | 210/363 |
| 3,389,881 | A | 6/1968 | Stelwagen | 248/18 |
| 3,391,469 | A | 7/1968 | Reeder | 34/58 |
| 3,459,461 | A | 8/1969 | Bannon, Jr. | 213/214 |
| 3,477,259 | A | 11/1969 | Barnish et al. | 68/23.1 |
| 3,509,742 | A | 5/1970 | Bauer | 68/23.1 |
| 3,531,954 | A | 10/1970 | Krupsky | 68/18 |
| 3,927,542 | A | 12/1975 | de Hedouville et al. | 68/17 |
| 4,114,406 | A | 9/1978 | Horowitz et al. | 68/24 |
| 4,295,387 | A | 10/1981 | Zhivotov et al. | 74/573 |
| 4,412,390 | A | 11/1983 | Grant | 34/58 |
| 4,446,706 | A | 5/1984 | Hartwig | 68/24 |
| 4,498,181 | A | 2/1985 | Menown et al. | 372/38 |
| 4,618,193 | A | 10/1986 | Cuthbert et al. | 312/264 |
| 4,819,460 | A | 4/1989 | Obradovic | 68/23.7 |
| 4,989,684 | A | 2/1991 | Conaway | 180/89.15 |
| 5,038,586 | A | 8/1991 | Nukaga et al. | 68/12.01 |
| 5,080,204 | A | 1/1992 | Bauer et al. | 188/129 |
| 5,199,690 | A | 4/1993 | Marshall | 267/64.25 |
| 5,209,458 | A | 5/1993 | Eubank et al. | 254/88 |
| 5,230,229 | A | 7/1993 | Stadelmann et al. | 68/23.1 |
| 5,267,456 | A | 12/1993 | Nukaga et al. | 68/12.24 |
| 5,280,660 | A | 1/1994 | Pellerin et al. | 8/158 |
| 5,526,657 | A | 6/1996 | Johnson | 68/3 |
| 5,657,649 | A | 8/1997 | Lim | 68/23.3 |
| 5,711,170 | A | 1/1998 | Johnson | 68/3 |
| 5,711,171 | A | 1/1998 | Uhlin | 68/4 |
| 5,768,730 | A | 6/1998 | Matsumoto et al. | 8/159 |
| 5,870,905 | A | 2/1999 | Imamura et al. | 68/12.04 |
| 5,913,951 | A | 6/1999 | Herr et al. | 81/158 |
| 5,961,105 | A | 10/1999 | Ehrnsberger et al. | 267/216 |
| 5,979,195 | A | 11/1999 | Bestell et al. | 68/23.2 |
| 6,032,494 | A | 3/2000 | Tanigawa et al. | 68/12.06 |
| 6,122,843 | A | 9/2000 | Noguchi et al. | 34/596 |
| 6,148,647 | A | 11/2000 | Kabeya et al. | 68/140 |
| 6,343,492 | B1 | 2/2002 | Seagar et al. | 68/142 |
| 6,363,756 | B1 | 4/2002 | Seagar et al. | 68/210 |
| 6,460,382 | B1 * | 10/2002 | Kim et al. | 68/140 |
| 6,474,114 | B1 | 11/2002 | Ito et al. | 68/140 |
| 6,477,867 | B1 | 11/2002 | Collecutt et al. | 68/12.06 |
| 6,481,035 | B2 | 11/2002 | Seagar et al. | 81/159 |
| 6,510,715 | B1 | 1/2003 | Simsek | 68/12.06 |
| 6,510,716 | B1 | 1/2003 | Kim et al. | 68/24 |
| 6,516,638 | B1 | 2/2003 | Myerscough | 68/23.1 |
| 6,539,753 | B1 | 4/2003 | Ito et al. | 68/3 |
| 6,557,383 | B1 | 5/2003 | Ito et al. | 68/23.2 |
| 6,564,594 | B1 | 5/2003 | Ito et al. | 68/24 |
| 6,578,225 | B2 | 6/2003 | Jönsson | 8/159 |
| 6,578,391 | B2 | 6/2003 | Seagar et al. | 68/142 |
| 6,626,014 | B2 | 9/2003 | Heyder et al. | 68/140 |
| 6,981,395 | B2 | 1/2006 | Ryu et al. | 68/17 |
| 7,073,356 | B2 | 7/2006 | Nakamura et al. | 68/12.26 |
| 7,334,799 | B2 | 2/2008 | O'Hara | 277/361 |
| 2002/0166349 | A1 | 11/2002 | Lim et al. | 68/23.7 |
| 2003/0056302 | A1 | 3/2003 | Broker et al. | 8/159 |
| 2004/0025544 | A1 | 2/2004 | Kim et al. | 68/3 |
| 2004/0031295 | A1 | 2/2004 | Choi | 68/24 |
| 2004/0035155 | A1 | 2/2004 | Yoon | 68/145 |
| 2004/0123631 | A1 | 7/2004 | Chang | 68/23.1 |
| 2004/0129035 | A1 | 7/2004 | Chang | 68/23 |
| 2004/0163428 | A1 * | 8/2004 | Kim et al. | 68/140 |
| 2004/0237603 | A1 | 12/2004 | Kim et al. | 68/15 |
| 2004/0244121 | A1 | 12/2004 | Lim et al. | 8/159 |
| 2004/0244168 | A1 | 12/2004 | Lee | 29/283.5 |
| 2005/0028564 | A1 | 2/2005 | Lee et al. | 68/24 |
| 2005/0188472 | A1 | 9/2005 | Park et al. | 8/158 |
| 2006/0010612 | A1 | 1/2006 | Kim et al. | 8/158 |
| 2006/0011429 | A1 | 1/2006 | Park et al. | 188/322.13 |
| 2006/0016228 | A1 * | 1/2006 | Chang et al. | 68/23.1 |
| 2006/0254321 | A1 | 11/2006 | Lim et al. | |
| 2007/0125135 | A1 | 6/2007 | Kim et al. | |
| 2007/0227200 | A1 | 10/2007 | Kim et al. | |

FOREIGN PATENT DOCUMENTS

| | | | |
|---|---|---|---|
| CN | 1511997 | A | 7/2004 |
| CN | 1515732 | A | 7/2004 |
| DE | 19 12 481 | U | 3/1965 |
| DE | 24 01 888 | A1 | 7/1975 |
| DE | 24 54 489 | A1 | 5/1976 |
| DE | 26 33 604 | A1 | 2/1978 |
| DE | 27 32 684 | A1 | 2/1978 |
| DE | 27 46 989 | A1 | 4/1978 |
| DE | 31 09 641 | A1 | 2/1982 |
| DE | 31 34 633 | A1 | 8/1982 |
| DE | 34 37 835 | A1 | 5/1985 |
| DE | 38 11 583 | A1 | 10/1989 |
| DE | 39 07 258 | A1 | 10/1989 |
| DE | 39 34 434 | A1 | 4/1991 |
| DE | 42 39 504 | A1 | 5/1994 |
| DE | 43 10 594 | A1 | 10/1994 |
| DE | 43 30 079 | A1 | 3/1995 |
| EP | 0 124 939 | B1 | 11/1984 |
| EP | 0 132 805 | A1 | 2/1985 |
| EP | 0 272 949 | B1 | 6/1988 |
| EP | 0 371 926 | A1 | 6/1990 |
| EP | 0 405 068 | B1 | 1/1991 |

| | | | |
|---|---|---|---|
| EP | 0 716 177 | B1 | 6/1996 |
| EP | 0 750 064 | A1 | 12/1996 |
| EP | 0 969 134 | A1 | 1/2000 |
| EP | 0 725 179 | B1 | 7/2000 |
| EP | 1 055 765 | A1 | 11/2000 |
| EP | 1 079 014 | B1 | 2/2001 |
| EP | 1 094 239 | B1 | 4/2001 |
| EP | 1 386 996 | B1 | 2/2004 |
| EP | 1 433 890 | B1 | 6/2004 |
| EP | 1 433 891 | A2 | 6/2004 |
| EP | 1 505 191 | A1 | 2/2005 |
| EP | 1 605 088 | A2 | 12/2005 |
| EP | 1 688 531 | A1 | 8/2006 |
| GB | 1120431 | | 7/1968 |
| GB | 2 096 649 | A | 10/1982 |
| GB | 2 157 326 | A | 10/1985 |
| GB | 2 202 867 | A | 10/1988 |
| JP | 48-64179 | | 8/1973 |
| JP | 54-028470 | | 3/1979 |
| JP | 56-116987 | A | 9/1981 |
| JP | 57-43792 | A | 3/1982 |
| JP | 59-211496 | A | 11/1984 |
| JP | 60-190998 | | 9/1985 |
| JP | 03-88479 | U | 9/1991 |
| JP | 04-092697 | A | 3/1992 |
| JP | 04-236988 | A | 8/1992 |
| JP | 04-240488 | A | 8/1992 |
| JP | 04-371194 | A | 12/1992 |
| JP | 05-084388 | A | 4/1993 |
| JP | 05-220293 | A | 8/1993 |
| JP | 06-079087 | A | 3/1994 |
| JP | 09-182368 | | 7/1997 |
| JP | 09-182370 | A | 7/1997 |
| JP | 10-201993 | A | 8/1998 |
| JP | 11-076680 | A | 3/1999 |
| JP | 2000-262796 | A | 9/2000 |
| JP | 2000-334194 | A | 12/2000 |
| JP | 2002-153695 | A | 5/2002 |
| JP | 2002-346281 | A | 12/2002 |
| JP | 2003-079995 | | 3/2003 |
| JP | 2003-230792 | A | 8/2003 |
| JP | 2004-513721 | | 5/2004 |
| JP | 2004-188204 | | 7/2004 |
| JP | 2005-198698 | | 7/2005 |
| JP | 2006-026408 | | 2/2006 |
| KR | 10-1999-0066050 | A | 8/1999 |
| KR | 10-1999-0079731 | A | 11/1999 |
| KR | 10-2001-0009545 | A | 2/2001 |
| KR | 10-2004-0011307 | A | 2/2004 |
| KR | 10-2004-0047223 | A | 6/2004 |
| KR | 10-2004-0058999 | A | 7/2004 |
| SU | 1181112 | A | 9/1986 |
| SU | 1663074 | A1 | 7/1991 |
| WO | WO 98/29595 | A2 | 7/1998 |

OTHER PUBLICATIONS

Notice of Opposition dated May 7, 2010 filed in the European Patent Office for European Patent Application No. 05013603.5 (Publication No. EP 1 619 286 B1).

U.S. Final Office Action dated May 14, 2010 issued in U.S. Appl. No. 12/230,031.

U.S. Office Action dated Dec. 30, 2005 issued in U.S. Appl. No. 10/461,451.

U.S. Final Office Action dated Aug. 14, 2006 issued in U.S. Appl. No. 10/461,451.

U.S. Final Office Action dated Dec. 13, 2006 issued in U.S. Appl. No. 10/461,451.

U.S. Office Action dated Jan. 5, 2007 issued in U.S. Appl. No. 11/475,885.

U.S. Office Action dated Apr. 27, 2007 issued in U.S. Appl. No. 10/461,451.

U.S. Office Action dated Jun. 8, 2007 issued in U.S. Appl. No. 11/470,704.

U.S. Final Office Action dated Jul. 17, 2007 issued in U.S. Appl. No. 11/475,885.

U.S. Office Action dated Nov. 19, 2007 issued in U.S. Appl. No. 10/461,451.

U.S. Office Action dated Nov. 30, 2007 issued in U.S. Appl. No. 11/470,704.

U.S. Office Action dated Apr. 1, 2008 issued in U.S. Appl. No. 11/475,885.

U.S. Final Office Action dated May 15, 2008 issued in U.S. Appl. No. 11/470,704.

U.S. Final Office Action dated Jun. 16, 2008 issued in U.S. Appl. No. 10/461,451.

U.S. Office Action dated Sep. 5, 2008 issued in U.S. Appl. No. 11/165,332.

U.S. Office Action dated Sep. 11, 2008 issued in U.S. Appl. No. 11/470,704.

U.S. Final Office Action dated Feb. 25, 2009 issued in U.S. Appl. No. 11/165,332.

U.S. Office Action dated Feb. 25, 2009 issued in U.S. Appl. No. 12/198,269.

U.S. Office Action dated Sep. 21, 2009 issued in U.S. Appl. No. 12/267,457.

U.S. Office Action dated Oct. 28, 2009 issued in U.S. Appl. No. 12/230,031.

U.S. Office Action dated Feb. 2, 2010 issued in U.S. Appl. No. 12/198,269.

European Search Report dated Feb. 3, 2010 issued in Application No. 09178918.0.

U.S. Final Office Action dated Mar. 5, 2010 issued in U.S. Appl. No. 12/267,457.

U.S. Final Office Action dated Oct. 14, 2009 issued in U.S. Appl. No. 12/198,269.

* cited by examiner

BEARING HOUSING ASSEMBLY OF DRUM-TYPE WASHING MACHINE AND DRUM-TYPE WASHING MACHINE WITH THE SAME

This application claims the benefit of the Korean Patent Application No. 10-2005-0092609, filed on Sep. 30, 2005, which is hereby incorporated in its entirety for all purposes as if fully set forth herein.

BACKGROUND OF THE INVENTION

1. Field of the Invention

The present invention relates to a bearing housing assembly provided with a bearing to support a drum rotational shaft and a drum-type washing machine. More particularly, the present invention is directed to a bearing housing assembly and a drum-type washing machine with the same, in which a damper for damping vibration of a drum is connected to a damper bracket which is coupled to the bearing housing.

2. Discussion of the Related Art

FIG. 1 is a sectional view illustrating an inner structure of a related art drum-type washing machine, and FIG. 2 is a sectional view taken along line II-II of FIG. 1.

As shown in FIG. 1 or FIG. 2, the related art drum-type washing machine includes a cabinet 1 having a base 1*a* and a door 1*b*, a tub 2 provided in an inner side of the cabinet 1, a drum 3 rotatably disposed in the tub 2 to rotate laundry m and washing water filled therein by use of a lift 3*a*, a motor 4 for rotating the drum 3, a spring 5, a damper 6, and a balancer 7, wherein the spring 5, the damper 6 and the balancer 7 serve to attenuate vibration transferred to the tub 2.

The drum 3 is provided with a plurality of holes 3*b* to allow the washing water, which is stored in the tub 2, to flow into drum 3. The lift 3*a* is disposed in an inner side of the drum 3 and is rotated with the drum 3, whereby the laundry m inside the drum 3 is lifted and dropped by the lift 3*a*.

The tub 2 is spaced apart from the inner side of the cabinet 1 at a predetermined interval, and is connected to the cabinet 1 by springs 5. The damper 6 is connected to the tub 2 and the base 1*a* by a hinge so that the tub 2 can be supported by the base 1*a*. The spring 5 and the damper 6 serve to dampen vibration transferred from the tub 2 to the cabinet 1.

The door 1*b* of the cabinet 1 is rotatably provided on a front surface 1*d* so that laundry m can be loaded into the drum 3. Respective front surfaces 2*d* and 3*d* of the tub 2 and the drum 3 are provided with openings 2*c* and 3*c* so that the drum 3 is accessible through the opening associated with the door 1*b*.

A gasket 8 is disposed between the front surface 1*d* of the cabinet 1 provided with the door 1*b* and the front surface 2*d* of the tub 2, and serves to prevent the washing water from leaking out of the tub 2. The gasket 8 seals a gap formed between the inner side of the cabinet 1 and the front surface 2*d* of the tub 2.

The motor 4 is disposed on a rear surface of the tub 2 and serves to rotate the drum 3 disposed inside the tub 2.

The balancer 7 is disposed in the drum 3 and serves to balance the rotating drum 3. Also, the balancer 7 is formed with a predetermined weight and serves to attenuate vibration of the drum 3 produced by a centrifugal force acting on the drum 3 when it is rotated at high speeds during a dehydrating cycle, for example a spin cycle.

In the aforementioned related art drum-type washing machine, vibration generated by a rotating part, such as the drum or the motor, is directly transferred to the tub, whereby the vibration transferred to the tub is reduced by the damper connected with the tub. However, in this structure of the related art drum-type washing machine, since vibration still affects the tub, it should be spaced apart from the cabinet by a certain interval so that the vibration of the tub is not directly transferred to the cabinet.

For this reason, when the size of the tub is increased to increase the capacity of the washing machine, the size of the cabinet must also be increased.

Furthermore, in the structure of the related art drum-type washing machine, since the vibration of the tub is relatively severe and the damper for attenuating the vibration is directly connected with the tub, the design of the tub must consider a structure in view of rigidity and strength in order to effectively attenuate the vibration. The design of the structure, including the materials necessary to accomplish attenuating the vibration, increases the overall weight of the washing machine and affects the arrangement of other parts inside the cabinet. Accordingly, the structure causes an increase in the overall cost of manufacturing the washing machine.

SUMMARY OF THE INVENTION

Accordingly, the present invention is directed to a bearing housing assembly and a drum-type washing machine with the same, which substantially obviates one or more problems due to limitations and disadvantages of the related art.

An advantage of the present invention is to provide a bearing housing assembly and a drum-type washing machine with the same, in which the bearing housing assembly is formed by insert injection molding to improve durability of the drum-type washing machine and facilitate its assembly.

Additional advantages, objects, and features of the invention will be set forth in part in the description which follows, and in part will be apparent from the description, or may be learned from practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a bearing housing assembly of a drum-type washing machine, the bearing housing assembly being formed by injection molding and including an insert housing, wherein the insert housing includes: a hub into which at least one bearing is inserted, the at least one bearing supporting a rotational shaft of a drum; a support portion extended from an outer circumference of the hub; and a coupling portion extended from the hub.

In another aspect of the present invention is a drum-type washing machine comprising: a tub receiving washing water therein; a drum rotatably disposed inside the tub; a drum rotational shaft transferring a rotational force of a motor to the drum; a damper bracket connected with a damper; and a bearing housing assembly formed by injection molding including an insert housing, wherein the insert housing includes a hub into which at least one bearing is inserted, the at least one bearing supporting the drum rotational shaft, a support portion extended from an outer circumference of the hub, and a coupling portion extended from the hub.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
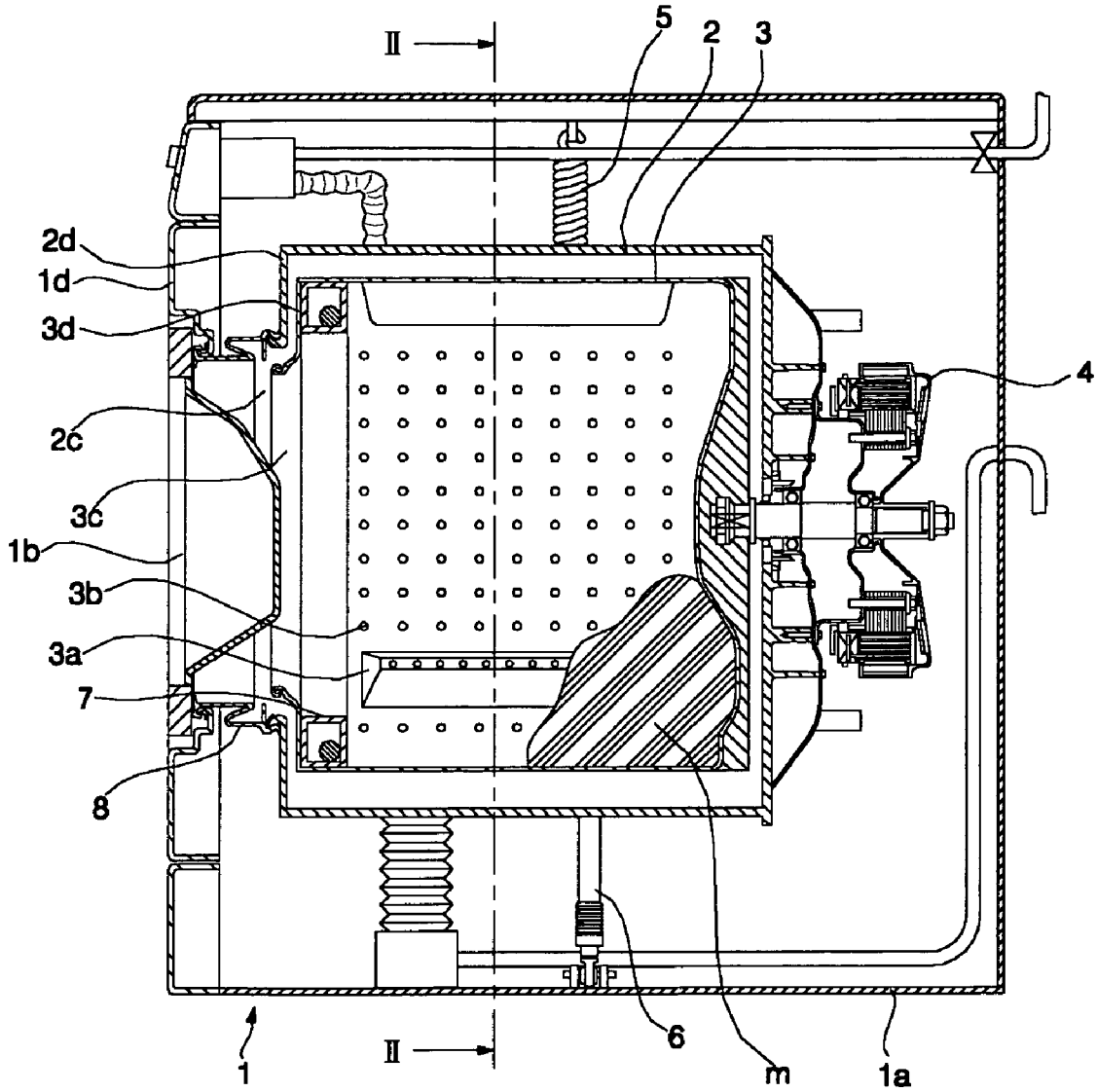
Fig. 1 Related Art
FIG. 1 is a sectional view illustrating an inner structure of a related art drum-type washing machine.
Figure 2:
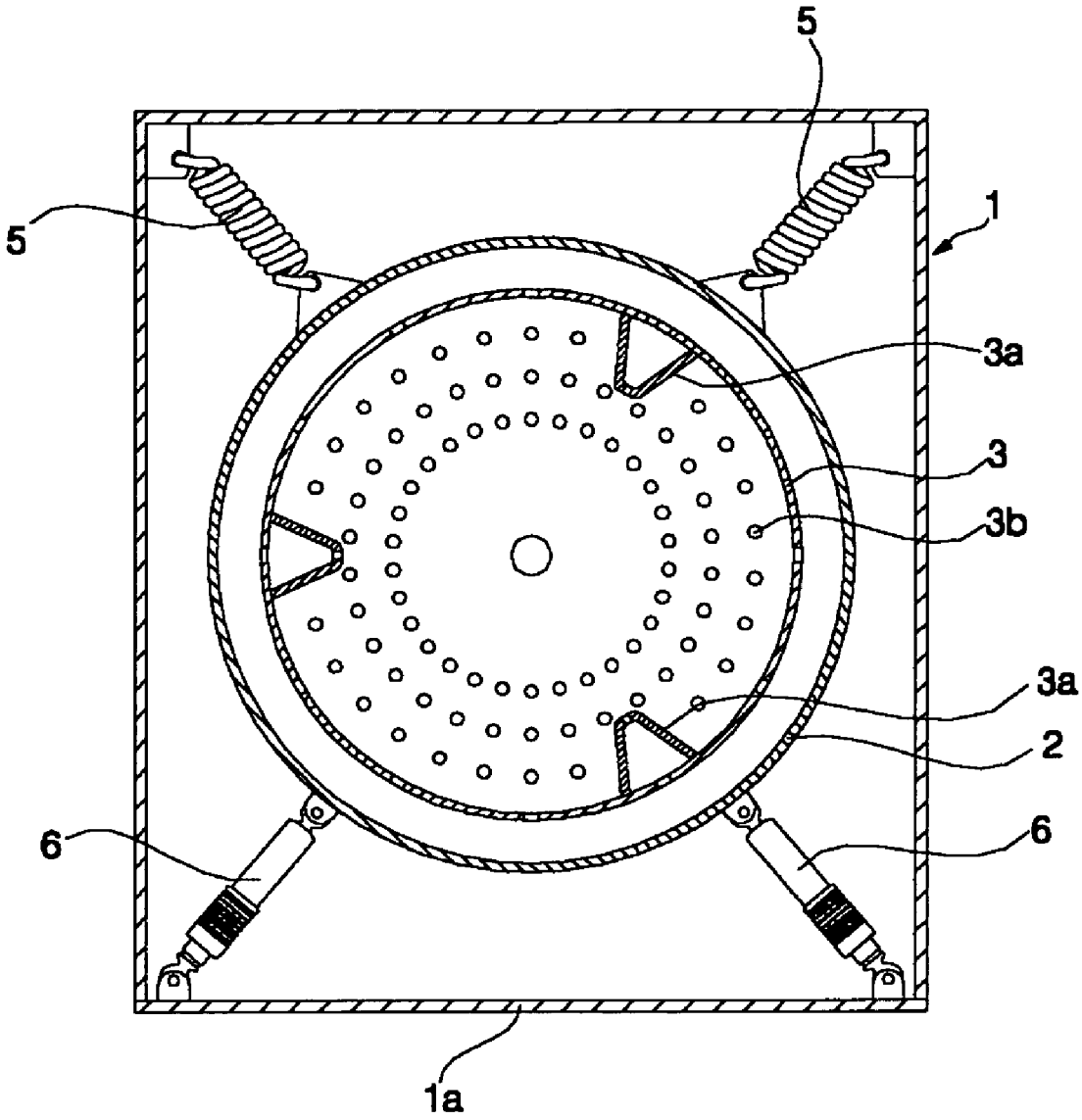
Fig. 2 Related Art
FIG. 2 is a sectional view along line II-II of FIG. 1.
Figure 3:
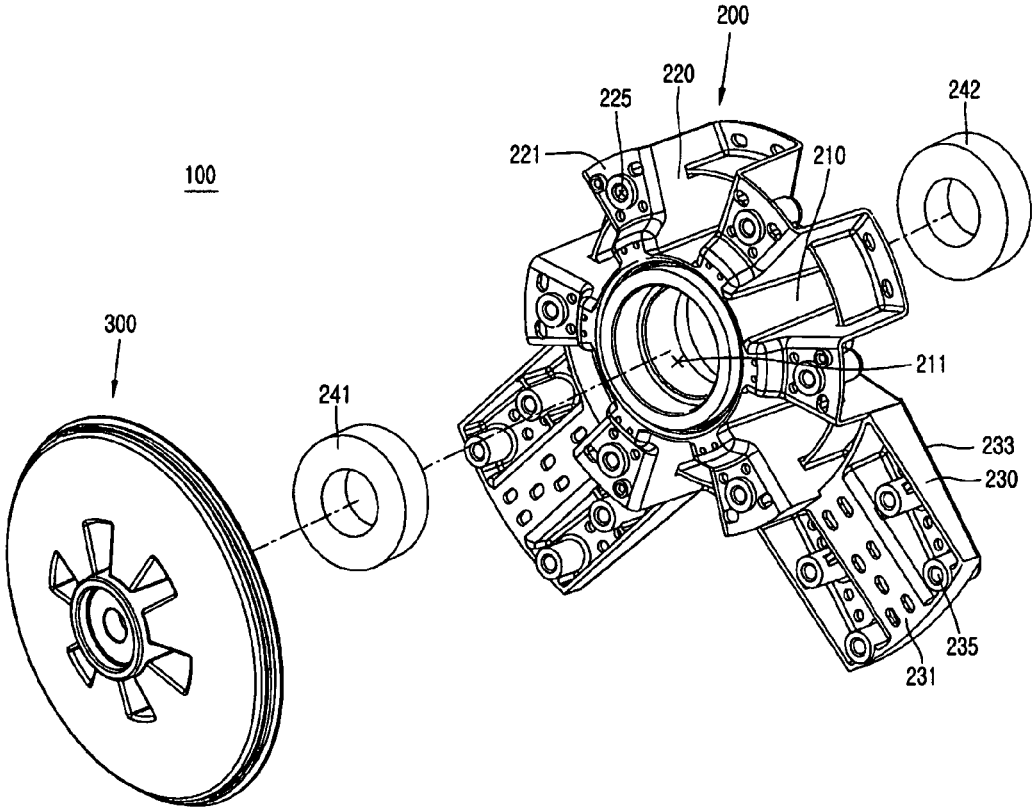
FIG. 3 is an exploded perspective view illustrating an insert injection type bearing housing assembly according to one embodiment of the present invention.

A bearing housing assembly 100 of FIG. 3 includes an insert housing 200 and a cover housing 300, wherein the cover housing 300 may be fixed to the insert housing 200 by an injection molding method. When injection molding is implemented, the cover housing 300 is made of a plastic material and is molded to cover at least one outer surface of the insert housing 200. A support portion 220 of the insert housing 200 is provided with a plurality of through holes, and during the injection molding process, melted plastic flows into the through holes and hardens so as to enhance bonding strength between the insert housing 200 and the cover housing 300.

Referring to FIG. 3, a coupling portion 230 is provided with a plurality of through holes in the same manner as the support portion 220. Thus, if the coupling portion 230 is also covered by the cover housing 300 along with the support portion 220, it serves to increase the bonding strength between the insert housing 200 and the cover housing 300.

Furthermore, the support portion 220 is provided with circumferential ribs, and the strength and rigidity of the support portion is reinforced by the ribs. The ribs are located in the concave portions so as to connect convex portions in between.

The insert housing 200 includes a hub 210 into which bearings 241 and 242 are inserted, the support portion 220 extends from the outer circumference of the hub 210 and includes first female threaded holes 225, and the coupling portion 230 extends from the support portion 220 and includes second female threaded holes 235.

Figure 7:
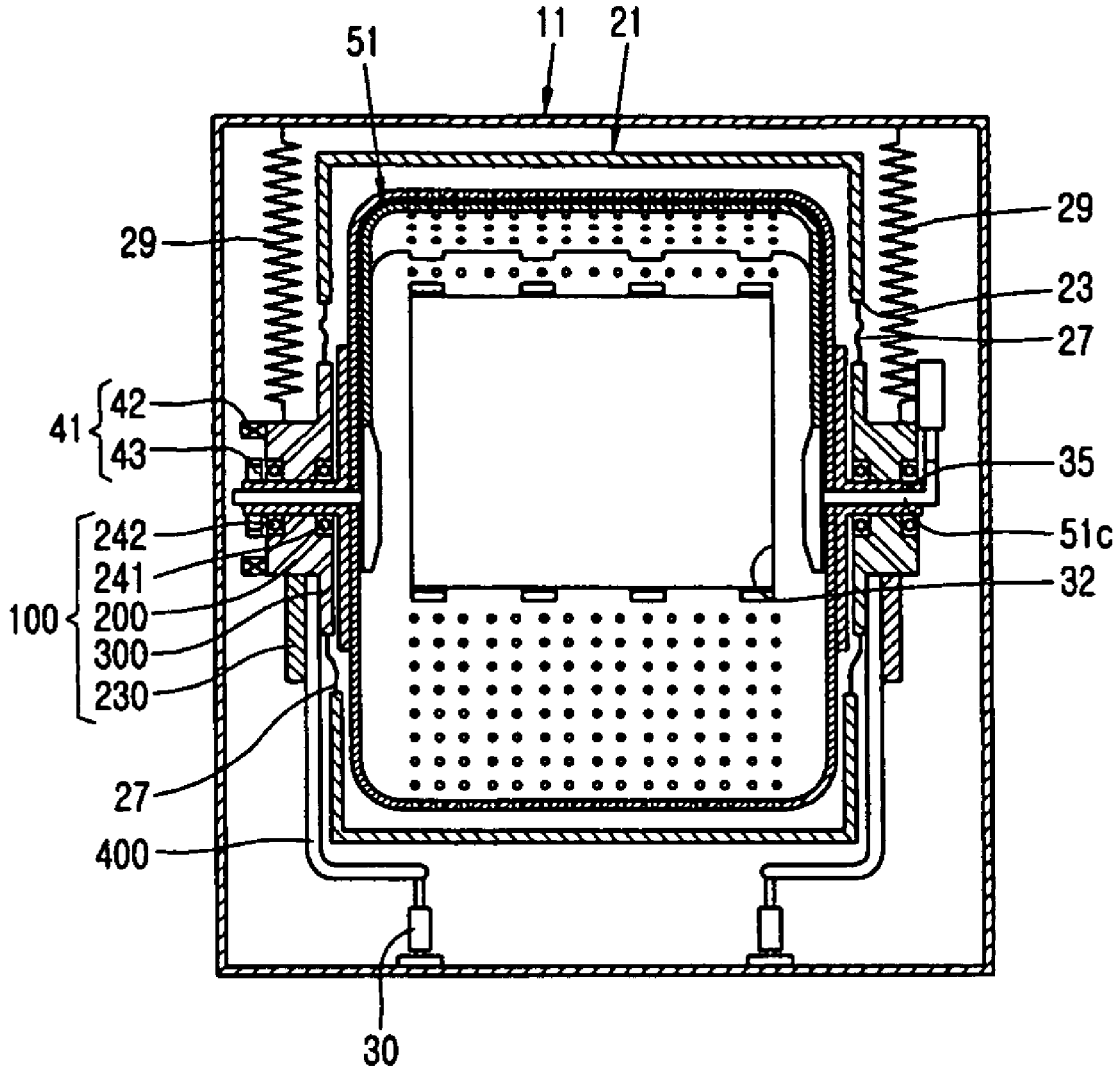
FIG. 7 is a front sectional view illustrating a drum-type washing machine according to another embodiment of the present invention.

The first bearing 241 and the second bearing 242 are inserted on either side of an central opening 211 of the hub 210 to rotatably support a drum rotational shaft 35 (see FIG. 7).

Figure 4:
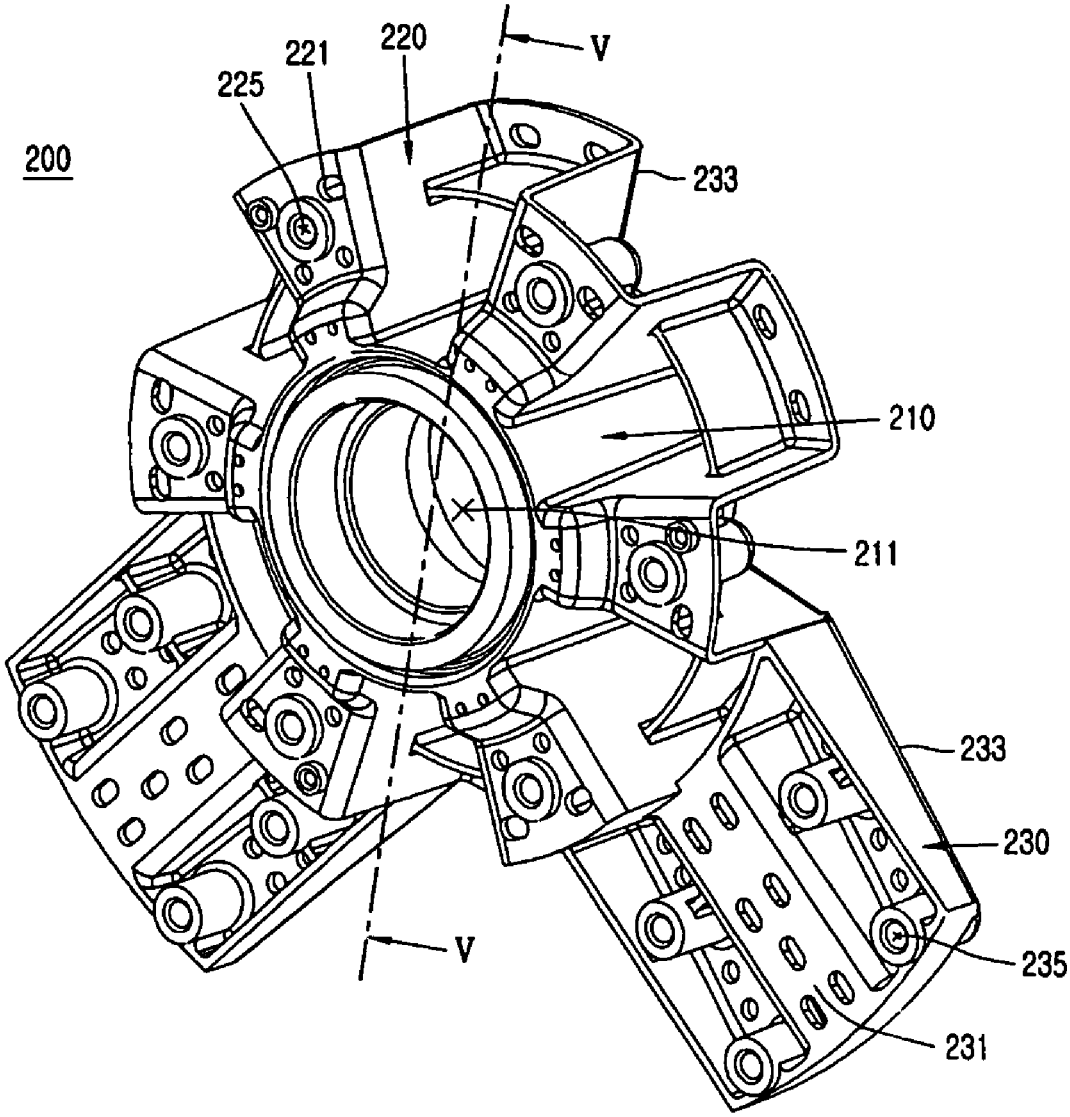
FIG. 4 is a perspective view illustrating an insert housing of FIG. 3, viewed from a front side.
Figure 5:
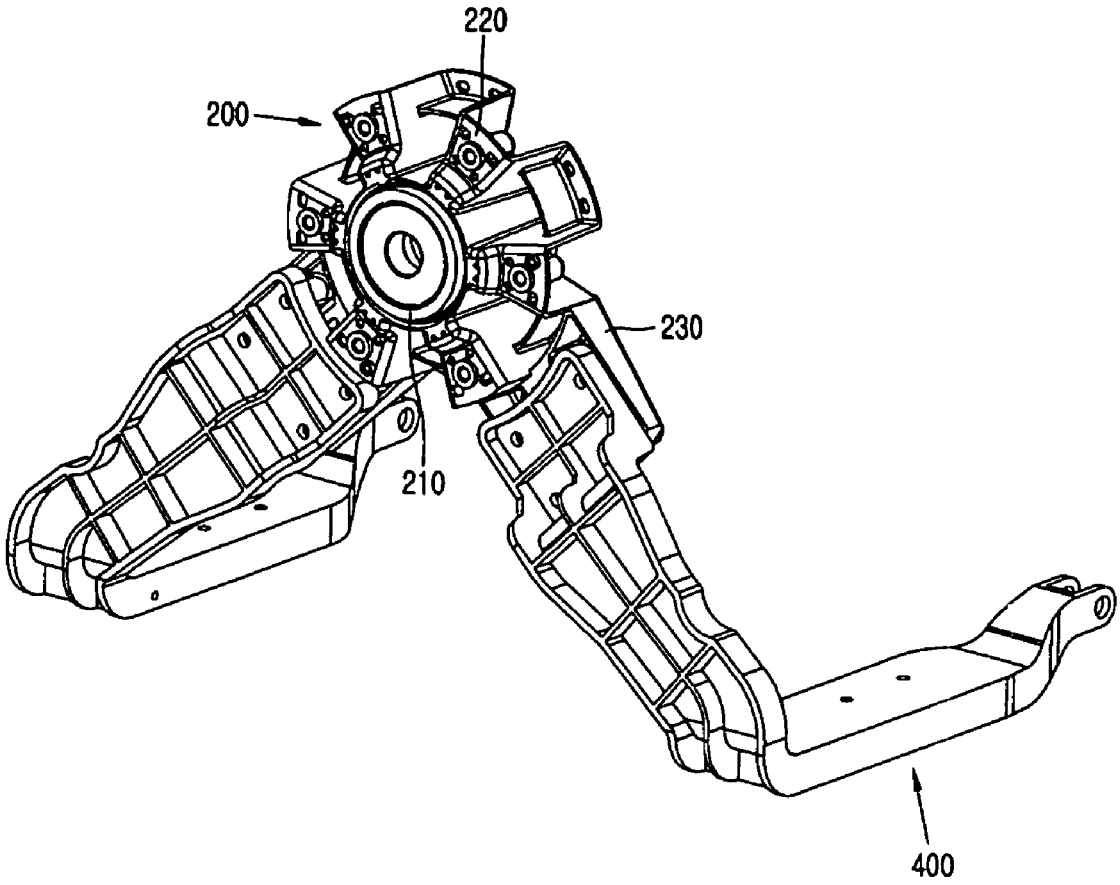
FIG. 5 is a perspective view illustrating a damper bracket fixed to the insert housing of FIG. 4, viewed from a rear side of the insert housing.
Figure 6:
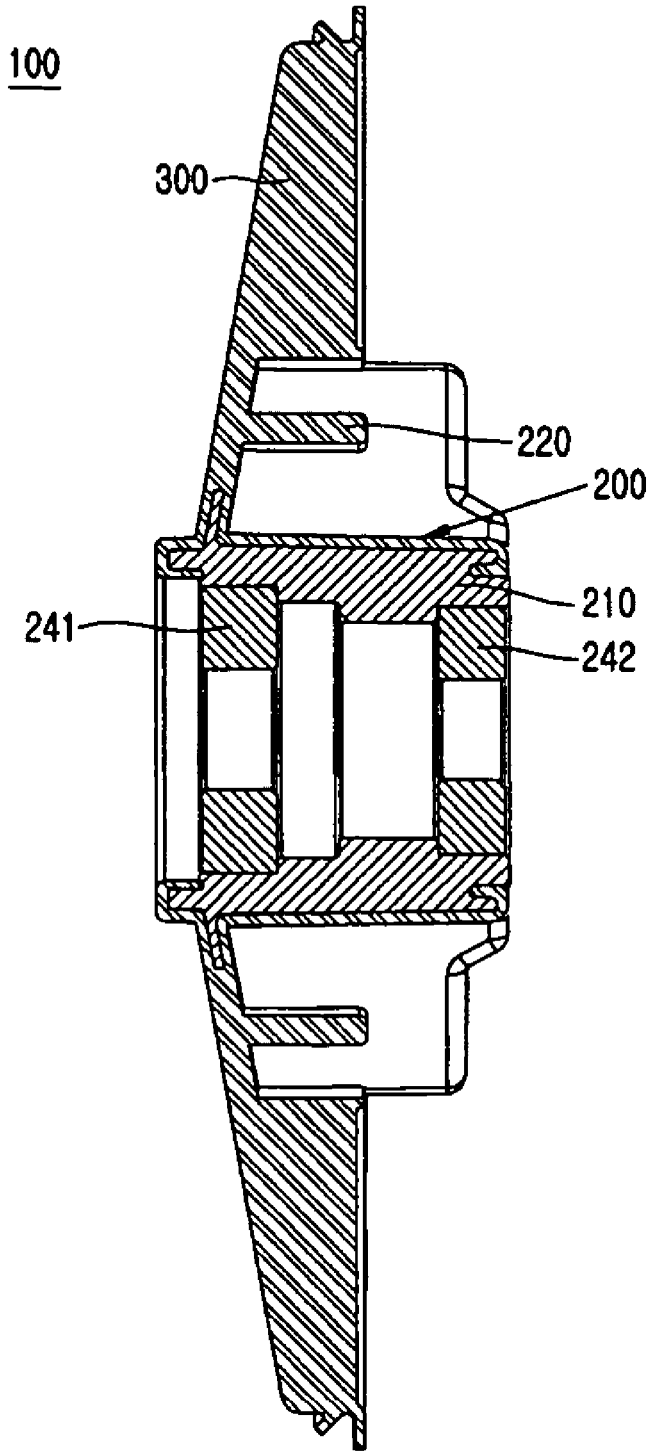
FIG. 6 is a sectional view along line V-V of FIG. 4.

The support portion 220 extends radially from the outer circumference of the hub 210 and has concave portions and convex portions in an alternating pattern. The support portion 220 is manufactured from, for example, a thin laminate having a plate thickness of 2 mm to 3 mm. As shown in FIGS. 3-5, a concave portion at one side of the support portion 220 is a convex portion at the other. Namely, a concave portion at the opposite side of the support portion 220 to the drum is a convex portion at the side where the drum is located.

As shown in FIG. 4, the convex portions on the rear surface of the support portion 220 are provided with first female threaded holes 225. In this embodiment, the rear surface is defined as the side opposite the side where the drum is located. The holes 225 are located in the aforementioned circular ribs. The ribs support the holes 225.

A stator of a motor can be fixed to the support portion 220 through the first female threaded holes 225. In the case where the stator of the motor is fixed to the support portion 220, the convex portions on the rear surface 233 of the support portion 220 are stepped so as not to interfere with a coil of the stator. Thus, the stator can be fixed to the support portion 220 more securely and a portion of the stator is now recessed within the support portion 220 thereby reducing the area necessary inside the cabinet.

The coupling portion 230 is extended from the hub 210 and protrudes further than the support portion 220. The coupling portion 230 can extend from the hub 210 several different ways. For example, the coupling portion 230 could be integral with the support portion 220, whereby the hub 210, the support portion 220 and the coupling portion 230 are all one piece or the coupling portion 230 can be manufactured separately and fixed to the support portion 220

The coupling portion 230 is coupled to a damper bracket 400. Accordingly, the coupling portion 230 has a thickness great enough to endure the loaded force. For example, the coupling portion 230 has a plate thickness greater than that of the support portion 220.

Next, the cover housing 300 is fixed to the front surface of the insert housing 200. The front surface 221 of the support portion 220 is covered by the cover housing 300 by injection molding, for example. The cover housing 300 can be made of a plastic material, and the insert housing 200 can be made of metal material, for example, aluminum.

The cover housing 300 may be formed to cover the coupling portion 230 as well as the support portion 220. Also, the cover housing 300 may be formed to cover one side or both sides of the insert housing 200.

As the bearing housing assembly is made by injection molding with an insert of the insert housing 200, it is not necessary to separately manufacture and assemble various parts, whereby the manufacturing process is simplified and the difficulties in assembling the washing machine are reduced.

Furthermore, since the first bearing 241 and the second bearing 242 are disposed together within the hub 210, misalignment of the shaft between the bearings 241 and 242 does not occur.

Moreover, the coupling portion 230, to which relatively great load is applied may be made of a rigid material, and the support portion 220 may be made of a thin plate, whereby the weight and size of the washing machine is reduced.

In a second embodiment, the drum-type washing machine may be provided with an insert injection molded bearing housing assembly which will be described with reference to FIG. 7.

FIG. 7 is a front sectional view illustrating the drum-type washing machine, especially a top loading drum-type washing machine provided with a bearing housing assembly.

The basic structure of a top loading drum-type washing machine is well known.

In the present application, the top loading drum-type washing machine includes a cylindrical cabinet 11 provided with an opening formed at one surface thereof, wherein a door is provided in the opening to allow the loading of laundry in and out of the washing machine.

Tub 21 is formed as a single body including an opening that corresponds to the opening of the cabinet 11 to load the laundry and through holes 23 at either side of the tub 21. A drum 51 is rotatably received within the tub 21 and is provided with the opening formed at one area of a circumferential surface, wherein the opening is aligned with the opening in the tub 21 to allow the loading of laundry in and out of the washing machine.

Furthermore, the top loading drum-type washing machine includes a bearing housing assembly 100 by which a drum rotational shaft 35 of the drum 51 is supported, wherein two bearing housing assemblies 100 are located at both sides of the tub 21.

A drum door 32 is rotatably disposed in the opening of the cabinet around a door rotational shaft 51*c* so as to open and close by rotating about the shaft 51*c*. A controller (not shown) is provided to control the drum 51 during wash cycles.

In the aforementioned top loading drum-type washing machine, the bearing housing assembly 100 includes an insert housing 200 and a cover housing 300 as described above, and supports the drum rotational shaft 35 fixed to the drum 31.

The first bearing 241 and the second bearing 242 are inserted within the opening 211 of the hub 210 of the inert housing 200, and rotatably support the drum rotational shaft 35. Moreover, a water seal (not shown) is inserted between the cover housing 300 and the front surface 221 of the support portion 220, and serves to prevent water from the tub 21 from flowing to the bearing housing assembly 100.

A stator 42 of a drum driving motor 41 is fixed to the rear surface 223 of the support portion 220 of the insert housing 200 by fitting bolts into the first female threaded holes 225. A rotor 43, corresponding to the stator 42, is fixed to the drum rotational shaft 35.

A gasket 27 is provided between the tub 21 and the bearing housing assembly 100 in the through holes 23 of the tub 21 so as to prevent water inside the tub 21 from leaking into the cabinet. The gasket 27 is flexible enough to prevent vibration transfer from the bearing housing assembly 100 to the tub 21.

Moreover, one end of a damper bracket 400 is fitted through the second female threaded holes 235 formed in the coupling portion 230 of the insert housing 200. The other end of the damper bracket 400 is fitted to the damper 30 to allow the damper 30 to damp vibration of the drum 31.

The damper bracket 400 is shown to have an inwardly bent shape. However, the damper bracket 400 may have any shape. In this embodiment, the damper bracket 400 is inwardly bent to position the bracket close to the center of gravity of the drum 31, whereby the damper can more stably damp vibration of the drum.

In FIG. 7, a spring 29 is provided between the cabinet and the bearing housing assembly.

In the above embodiment, while the top loading washing machine has been exemplarily described, the present invention can be applied to a front loading washing machine.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A bearing housing of a laundry machine, the bearing housing comprising:

a hub into which at least one bearing is inserted;

a support portion that extends radially outward from an outer circumference of the hub;

a coupling portion that extends radially outward from the hub or the support portion; and a non-metallic material insert molded on a surface of the insert housing that is configured to face an inside of a tub of the laundry machine.

2. The bearing housing of a laundry machine as claimed in claim 1, wherein the support portion includes a plurality of female threaded holes formed therein, wherein the plurality of female threaded holes are configured to fix a stator of a drum driving motor thereto.

3. The bearing housing of a laundry machine as claimed in claim 2, wherein the support portion includes a plurality of alternately arranged concave portions and convex portions along a circumferential direction.

4. The bearing housing of a laundry machine as claimed in claim 3, wherein the support portion includes a rib that extends in a circumferential direction.

5. The bearing housing of a laundry machine as claimed in claim 3, wherein each of the plurality of convex portions have a stepped shape.

6. The bearing housing of a laundry machine as claimed in claim 1, wherein the coupling portion extends radially outward from the support portion.

7. The bearing housing of a laundry machine as claimed in claim 6, wherein a plate thickness of the coupling portion is greater than that of the support portion.

8. The bearing housing of a laundry machine as claimed in claim 1, wherein the bearing housing comprises two arrays of fastening holes, the two arrays of fastening holes being spaced apart from each other in a radial direction.

9. The bearing housing of a laundry machine as claimed in claim 1, wherein the first coupling portion comprises a plurality of fastening holes configured to be connected to a damper bracket.

10. The bearing housing of a laundry machine as claimed in claim 1, wherein a portion of the insert housing is configured to form a water tight connection with a gasket provided between the tub and the bearing housing.

* * * * *